US006834521B1

(12) United States Patent
Denker et al.

(10) Patent No.: US 6,834,521 B1
(45) Date of Patent: Dec. 28, 2004

(54) METHOD AND DEVICE FOR DRYING AND KEEPING DRY ESPECIALLY COLD-ROLLED STRIP IN THE DELIVERY AREA OF COLD-ROLLING AND STRIP-ROLLING PLANTS

(75) Inventors: Wolfgang Denker, Freudenberg (DE); Michael Hanisch, Remscheid (DE); Hans-Peter Richter, Friedewald (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/914,710

(22) PCT Filed: Feb. 16, 2000

(86) PCT No.: PCT/EP00/01235

§ 371 (c)(1),
(2), (4) Date: Aug. 31, 2001

(87) PCT Pub. No.: WO00/51757

PCT Pub. Date: Sep. 8, 2000

(30) Foreign Application Priority Data

Mar. 1, 1999 (DE) ..... 199 08 743

(51) Int. Cl.[7] ..... B21B 45/02
(52) U.S. Cl. ..... 72/39; 72/201
(58) Field of Search ..... 72/38, 39, 40, 72/250; 29/81.09; 277/301, 304

(56) References Cited

U.S. PATENT DOCUMENTS

| | | | | |
|---|---|---|---|---|
| 2,900,991 A | | 8/1959 | Arnold | |
| 3,192,752 A | * | 7/1965 | Dowd et al. | 72/45 |
| 4,400,961 A | * | 8/1983 | Schaming | 72/201 |
| 4,477,287 A | * | 10/1984 | Kush et al. | 134/15 |
| 4,552,003 A | | 11/1985 | Kolecki | |
| 5,313,685 A | * | 5/1994 | Kramer et al. | 15/309.1 |
| 5,775,152 A | * | 7/1998 | Daub et al. | 134/15 |

FOREIGN PATENT DOCUMENTS

| | | | | |
|---|---|---|---|---|
| DE | 4305907 A1 | * | 8/1994 | B08B/5/00 |
| DE | 195 35 168 A1 | | 3/1997 | |
| FR | 2212187 | | 7/1974 | |
| GB | 1481022 | | 7/1977 | |
| GB | 1481022 A | * | 7/1977 | C23G/3/02 |
| WO | 9505251 | | 2/1995 | |

OTHER PUBLICATIONS

"Novel Seal Designs Thwart Leaks" Chemical Engineering; New York, May 1996.*

Patent Abstracts of Japan, vol. 012, No. 137 (M–690), Apr. 26, 1988 & JP 62 259611 A (Nisshin Steel Co Ltd), Nov. 12, 1987.

Muellerr W F et al: IBM Technical Disclosure Bulletin, Ed. 22, No. 9, Feb. 1980, pps. 4066–4067 XP002137866.

* cited by examiner

*Primary Examiner*—Lowell A. Larson
(74) *Attorney, Agent, or Firm*—Friedrich Kueffner

(57) ABSTRACT

In a method for drying and keeping dry rolled strip in a delivery area of strip-rolling plants, a partition is arranged in the delivery area for separating a damp area of the rolling mill from a dry area. The partition extends from the base plate to the stand platform. The strip is subjected to pressurized gas by the ends of the partition facing the strip at a right angle to the strip surface from above and below. Across the strip width a cushion of a compressed gas is generated and seals a gap between the ends of the partition facing the strip and the upper and lower strip surfaces. The compressed gas is guided away above and below the strip parallel to the strip surface as a split flow toward the rolling mill or the damp area and as a split flow in the opposite direction toward the dry area.

12 Claims, 2 Drawing Sheets

METHOD AND DEVICE FOR DRYING AND KEEPING DRY ESPECIALLY COLD-ROLLED STRIP IN THE DELIVERY AREA OF COLD-ROLLING AND STRIP-ROLLING PLANTS

BACKGROUND OF THE INVENTION

1. Field of the Invention

The invention relates to a method and a device for drying and keeping dry especially rolled strip (cold-rolled strip) up to approximately 10 mm thickness, preferably smaller than 0.2 mm thickness, in the delivery area of cold rolling and strip-rolling plants, wherein, for separating the "damp area" of the rolling mill relative to the further delivery area, "dry area", downstream of the last roll stand, a partition is arranged whose upper part extends above the strip up to the stand platform and whose lower part below the strip extends down to the base plate.

2. Description of the Related Art

In the delivery area of rolling mills the required quality of the product "cold-rolled strip", in addition to good flatness and optimal thickness tolerance, includes also dryness and cleanness of the strip surface because otherwise surface errors, for example, stains, are unavoidable during further processing of the strip.

In order to obtain a dry strip surface and to shield it relative to the damp area of the rolling mill and to protect it in this way from becoming wet again, for example, by undesirable condensation of the vapors which are emitted by the rolling stand, different devices and measures are known, such as, for example, partitions, removal by vacuum, removal by blowing as well as combinations thereof.

Accordingly, in DE 28 44 434 A1 it is suggested to remove by vacuum liquid residue from sheet metal and strips continuously transported through particularly rolling mills and strip treatment plants in a defined area transverse across the sheet metal surface by means of vacuum generated with suction tubes, that is, by means of the vacuum flows produced thereby. The suction tubes provided with a longitudinal slot have attached laterally thereto sealing lips of rubber, plastic, or brushes which laterally seal the suction area relative to the strip.

From DE 44 22 422 A1 a device for a contactless sealing of a gap between a partition and a working roll in the delivery area of a roll stand is known. The end of the partition is positioned contactless with a minimal gap-shaped spacing substantially tangentially at the surface of the working roll. The gap which is formed in this way between the partition and the working roll is sealed by an energy-rich flow (in the form of compressed air) exiting from a gap nozzle arranged in the end area of the partition. The underpressure, which is produced in this way by the flow as a result of the cutting edge-like tapered configuration of the end portion and its arrangement relative to the working roll, has the effect that additionally larger amounts of air are taken through the gap and flow in the direction toward the damp area of the working roll. This provides a defined flow between partition and the rolling stock, and the wet air with droplets and other particles is removed by suction within the flow area.

A further type of partition for keeping dry cold-rolled strip in the delivery area of a roll stand by deflecting means for deflecting liquid rolling medium and/or for removing sprayed or splashed liquid adhering to surfaces of the strip is described in DE 195 35 168 A1. The partition, comprised of a fixedly installed part and a movable part arranged at the strip side (for making possible a problem-free exchange of the rolls), extends above the strip delivery area up to the stand platform and below the strip delivery area down to the base plate. On the movable part of the partition the following device parts are arranged:

- a roll barrel blowing device for removing squeezed-off rolling medium from the finish-rolled strip;
- a roll barrel gap seal for sealing the roll space located above the strip relative to the strip;
- a strip edge blowing device for generating an air flow at a right angle to the strip in the roll gap at the delivery side above the running strip by which the entrained rolling oil is deflected away from the strip laterally of the strip edge;
- a vapor suction device configured to generate a parallel air flow counter to the strip running direction above and below the strip.

SUMMARY OF THE INVENTION

Based on this known prior art, wherein in many cases the strip is subjected to a vacuum action or an air flow is directed against the working roll, the object of the invention is to configure a simple method and a device, based on this method and comprised of simple components which are suitable for rolling mills, for a contactless sealing of a gap between a partition and a strip at the delivery area of cold-rolling and strip rolling devices such that, with an acceptable energy expenditure and a minimal noise development, a dry strip surface as well as a complete separation of the damp-wet roll area from the finish-rolled strip are achieved by developing the known devices further.

The object is solved according to the invention in regard to a method of the aforementioned kind in that the strip is subjected, by the ends of the partition facing the strip and its components, to a gas under pressure, preferably air, at a right angle to the strip surface from above and from below via blast nozzles, so that across the entire strip width an air cushion-like compressed gas buffer is generated in the gap between the ends of the partition facing the strip and the upper and lower strip surfaces, the gap having a width of 0.1 to 1 mm, preferably 0.2 mm, and the compressed gas is guided away above and below the strip parallel to the strip surface in the form of a split flow in the direction toward the rolling mill or the damp area and of a split flow in the opposite direction toward the dry area, and in regard to the device by blast nozzle bars arranged at the end of the movable partitions facing the strip across the entire strip width having blast nozzles oriented perpendicularly onto the strip surface and blast nozzle surfaces formed facing the strip and extending parallel to the strip surface.

By means of the measure of the invention of sealing the gap between the partition and the strip above and below the strip by an air cushion-like compressed gas buffer, wherein the compressed gas above and below the strip is removed additionally in the form of a split flow parallel to the strip surface in the direction toward the rolling mill and in the opposite direction, even at high strip speeds of more than 1,000 m per minute, independent of the strip width, a penetration of rolling oil or emulsion is prevented successfully and a contactless strip drying is achieved.

By means of the generated split flow extending parallel to the strip surface, it is furthermore safely prevented that rolling oil or emulsion can penetrate laterally past the strip. Also, liquid that is running downwardly on the upper partition is returned in a directed manner to the rolling mill by this split flow.

The pressure with which the gas is guided at a right angle from above and below against the strip surface is approximately 1 to 10 bar, preferably approximately 5 bar, which ensures that the generation of an air cushion-like compressed gas buffer required for an optimal sealing action is realized and that the subsequent split flow is energy-rich enough in order to prevent penetration of moisture. In order to make this possible with an energy amount and noise development as minimal as possible, the gap between the partition and the strip is, if possible, adjusted to 0.1 to 1 mm, preferably to 0.2 mm, the strip thickness being added to this, in order to achieve the desired effect for a predetermined gas pressure with gas quantities as minimal as possible.

A device for performing this method is comprised of a partition arranged above and below the strip whose stationary installed parts are positioned above the strip so as to extend up to the stand platform and below the strip down to the base plate. In the direction facing the strip, these fixedly installed partition components are extended by movable (slidable) partition components so far that between these movable partition components and the strip surface a narrow gap is adjusted. This gap can be adjusted by moving the movable partition components against a stationary or adjustable stop to realize a predetermined gap width, or it is adjusted automatically as a result of the compressed gas buffer. According to a preferred embodiment of the invention, the gap is, independent of the strip thickness, 0.1 to 1 mm, preferably 0.2 mm.

The end of the movable partition facing the strip is formed by a blast nozzle bar, respectively, in which bores (blast nozzles) are arranged through which a gas is guided under pressure against the strip surface. According to another advantageous embodiment of the invention, approximately 250 blast nozzles, per meter of bar length, with a diameter of approximately 1 mm are arranged in the blast nozzle bar. Advantageously, the blast nozzles are arranged successively transverse across the entire strip width centrally within the blast nozzle bar. However, it is also possible to provide, instead of the blast nozzle bores, a continuous slot nozzle in the blast nozzle bar having a slot width of, for example, 1 mm.

As a result of the size of the blast nozzle bar—its length corresponds at least to the strip width and its width is approximately 10 to 500 mm, preferably approximately 60 mm—as well as of the blast nozzle bar surface formed parallel to the strip surface at the side facing the strip, the compressed gas which centrally exits (relative to the width of the blast nozzle bar) from the blast nozzles is able to build up the required air cushion-like compressed gas buffer for a reliable sealing action. Moreover, as a result of the wide configuration of the blast nozzle bar surface at the side facing the strip, whose width projects considerably past the area of the blast nozzle openings and which extends parallel to the strip surface, it is achieved that the gap to be sealed is wide enough in the direction of the strip length in order to maintain, by means of the compressed gas, a reliably acting split flow parallel to the strip surface in the direction toward the rolling mill and in the opposite direction.

BRIEF DESCRIPTION OF THE DRAWINGS

Further advantages, details, and features of the invention will be explained in the following with the aid of an embodiment illustrated in the drawing figures.

It is shown in.

DESCRIPTION OF PREFERRED EMBODIMENTS

Figure 1:
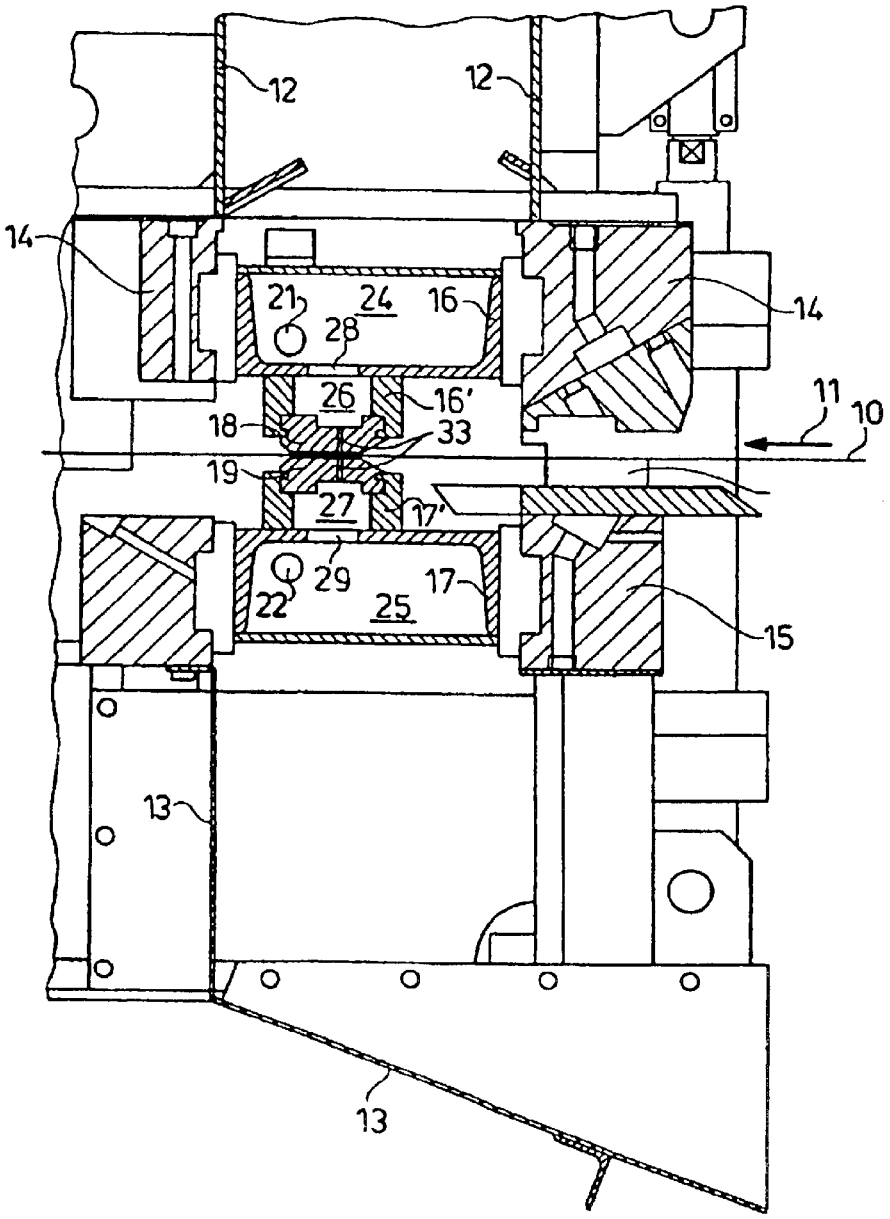
FIG. 1 a side view of a detail of the partition and gap sealing at the delivery area of a roll stand (partially in section), FIG. 2 a schematic enlarged detail of the blast nozzle bar according to FIG. 1.

In FIG. 1, the delivery area of a roll stand (the roll stand has not been illustrated; it is positioned to the right of FIG. 1) with a strip 10 being transported in the direction of arrow 11 is schematically illustrated.

Above and below the strip 10 a stationary installed partition 12, 13 is provided whose upper part 12 extends up to the stand platform (not illustrated) and whose lower part 13, for the purpose of return of separated liquid, is positioned at a slant downwardly in the direction of the roll stand. The partition 12, 13 opens at the strip into a frame 14, 15 which is also stationary arranged or is moveably configured and arranged in a movable blast nozzle support 16, 16', 17, 17'. The end of the partition 12, 13 facing the strip provided with the blast nozzle support 16, 16', 17, 17' is formed by blast nozzle bars 18, 19 with centrally arranged blast nozzles 23 in the form of bores which are fastened at the side facing the strip on the blast nozzle supports 16', 17' and which, by means of the movable arrangement of the frames 14, 15 and the movable arrangement of the blast nozzle supports 16, 16', 17, 17', can be moved into a position very close to the strip 10. An adjustable or fixedly installed stop 20 ensures that a certain gap width between the blast nozzle bars 18, 19 and the surface of the strip 10 is adjustable in this connection or is adjusted automatically as a result of the compressed gas buffer, wherein, as a result of the possibility of the movability of the blast nozzle bars, this gap can thus be adjusted also to different strip thicknesses. Together with the components of the blast nozzle supports 16, 16', 17, 17', the blast nozzle bars 18, 19 form chambers 24, 25, 26, 27, i.e., inner chambers 24, 25 and outer chambers 26, 27 which are in communication with one another via the chamber openings 28, 29. The inner chambers 24, 25 can be filled with the compressed gas via inlet openings 21, 22, and the gas then flows via the chamber openings 28, 29 into the outer chambers 26, 27, and from there it is guided via the blast nozzles 23 perpendicularly onto the surface of the strip 10. As a result of the configuration of the chambers above or below the blast nozzle bar, a reservoir as well as a homogenization for the compressed gas is advantageously provided.

Figure 2:
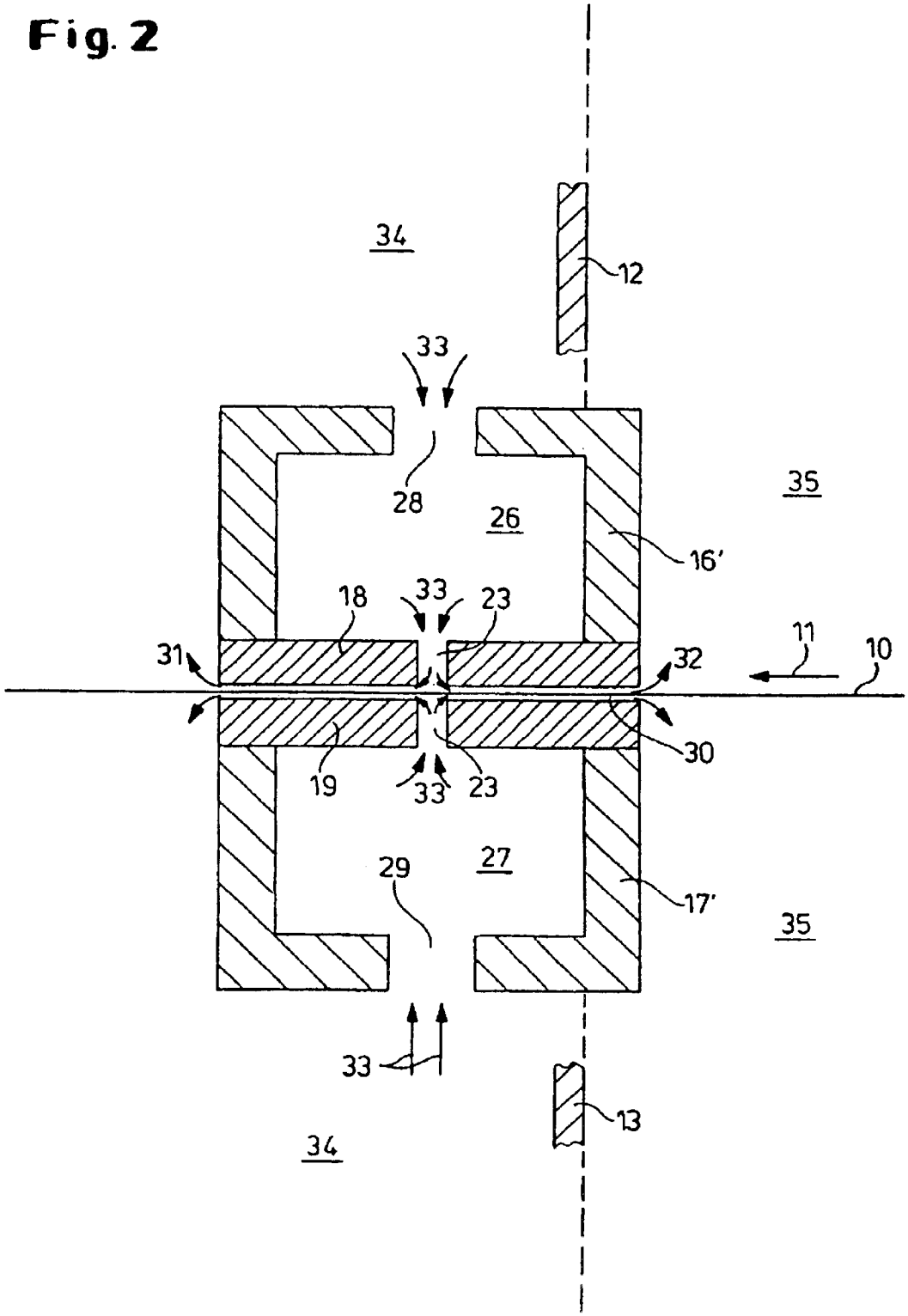

FIG. 2 illustrates the resulting flow directions of the compressed gas, beginning only at the outer chambers 26, 27, in a schematic detail illustration. Even though the components of FIG. 2 are illustrated very schematically and differ in their shape from the components of FIG. 1, the same reference numerals are used for the same components in order to provide a better understanding.

The device according to the invention functions as follows: compressed gas 33 flows from the inner chambers 24, 25 (the chambers are not illustrated in FIG. 2) through the chamber openings 28, 29 into the outer chamber 26, 27 and from there through the blast nozzles 23 perpendicularly onto the surface of the strip 10 and forms here a compressed gas buffer in the gap 30 above and below the strip 10. In the gap 30 the compressed gas 33 is divided and flows in a split flow 32 to the damp area 35 of the roll stand (in FIG. 2 to the right) and in the opposite direction as a split flow 31 to the dry area 34 of the finish-rolled strip (in FIG. 2 to the left). Accordingly, since the blast nozzle bars 18, 19 are formed with a wide blast nozzle bar surface area facing the strip and extending parallel to the strip surface, a long gap results corresponding to the width of the blast nozzle bars so that here the desired split flow 31, 32 can be generated also.

For a better understanding, FIG. 2 schematically shows the partition 12, 13 in order to indicate that by cooperation of the partition with the compressed gas buffer and the split flow 31, 32 a separation of the dry area 34 with the finish-rolled strip from the damp area 35 of the roll stand is achieved.

The embodiment illustrated in the drawing figures is only one possible application of the invention. It is, for example, possible to configure the blast nozzle bars, the number and arrangement of the blast nozzles as well as the configuration of the blast nozzle supports differently from the illustrated embodiment as long as in this case the basic principle of the invention, the configuration of an air cushion-like compressed gas buffer with a split flow at both surfaces areas of the strip, is maintained. Moreover, the compressed gas chambers formed above and below the blast nozzle bar are not necessarily required in order to realize the subject matter of the invention. Moreover, the method according to the invention as well as the device are also suitable and applicable for drying and keeping dry any desired profile sections. The corresponding constructive adaptation is within the skill of the artisan.

What is claimed is:

1. A method for drying and keeping dry rolled strip up to 10 mm thickness in a delivery area of cold-rolling and strip-rolling plants, the method comprising the steps of:

arranging a partition in the delivery area for separating a damp area (35) of the rolling mill from a dry area (34) that is a further delivery area downstream of a last roll stand, wherein an upper part of the partition above the strip (10) extends up to a stand platform and a lower part of the partition below the strip (10) extends down to base plate;

subjecting the strip (10) to a gas under pressure at a right angle to the strip surface from above and from below via blast nozzles (23) provided on the ends of the partition (12, 13) facing the strip and on the components (14, 15, 16, 16', 17, 17') of the partition and sealing across the entire strip width a gap (30) between the ends of the partition (12, 13; 14, 15) facing the strip and the upper and lower strip surfaces by a cushion of a compressed gas buffer generated by the gas under pressure, wherein the gap has a width of 0.1 to 1 mm, wherein the components of the partition include a movable partition and blast nozzle bars arranged at ends of the movable partition facing the strip and extending across the entire strip width, wherein the movable partition and the blast nozzle bars form inner chambers (24, 25) and outer chambers (26, 27), and wherein the inner and outer chambers are in communication with each other through chamber openings (28, 29), the blast nozzle bars being configured as individual parts, the movable partitions having guide flanges that are guided in grooves in the blast nozzle bars so that the blast nozzle bars are removable from sides of the movable partitions;

guiding the compressed gas (33) away above and below the strip (10) parallel to the strip surface in the form of a split flow (32) in the direction toward the rolling mill or the damp area (35) and of a split flow (31) in the opposite direction toward the dry area (34).

2. The method according to claim 1, wherein, in the step of guiding, the compressed gas (33) is applied at a pressure of 1 to 10 bar from below and above onto the strip surface.

3. The method according to claim 1, wherein the gas is air.

4. The method according to claim 1, wherein the width of the gap is 0.2 mm.

5. The method according to claim 1, wherein the thickness of the rolled strip is less than 0.2 mm.

6. A device for drying and keeping dry rolled strip up to 10 mm thickness in a delivery area of cold-rolling and strip-rolling plants, by arranging a partition in the delivery area for separating a damp area (35) of the rolling mill from a dry area (34) that is a further delivery area downstream of a last roll stand, wherein an upper part of the partition above the strip (10) extends up to a stand platform and a lower part of the partition below the strip (10) extends down to base plate; by subjecting the strip (10) to a gas under pressure at a right angle to the strip surface from above and from below via blast nozzles (23) provided on the ends of the partition (12, 13) facing the strip and on the components (14, 15, 16, 16', 17, 17') of the partition and sealing across the entire strip width a gap (30) between the ends of the partition (12, 13; 14, 15) facing the strip and the upper and lower strip surfaces by a cushion of a compressed gas buffer generated by the gas under pressure, wherein the gap has a width of 0.1 to 1 mm; and by guiding the compressed gas (33) away above and below the strip (10) parallel to the strip surface in the form of a split flow (32) in the direction toward the rolling mill or the damp area (35) and of a split flow (31) in the opposite direction toward the dry area (34); the device comprised of:

a stationary partition (12, 13) stationary arranged above and below the strip (10) and having an upper part (12) above the strip (10) extending up to the stand platform and having a lower part (13) below the strip (10) extending down to the base plate;

a movable partition (16, 16', 17, 17') comprising frames (14, 15) configured to extend the stationary partition (12, 13) to a location closely above and below a strip surface of the strip;

blast nozzle bars (18, 19) arranged at ends (16', 17') of the movable partition facing the strip and extending across the entire strip width, the blast nozzle bars being configured as individual parts, the movable partitions having guide flanges that are guided in grooves in the blast nozzle bars so that the blast nozzle bars are removable from sides of the movable partitions;

the blast nozzle bars (18, 19) having blast nozzles (23) oriented perpendicularly relative to the strip surface and blast nozzle surfaces facing the strip and extending parallel to the strip surface and configured to create a seal, across the entire strip width, in a gap (30) between the ends of the partition (12, 13; 14, 15) facing the strip and the upper and lower strip surfaces by a cushion of a compressed gas buffer generated by a gas under pressure ejected by the blast nozzle bars (18, 19), wherein the movable partition (16, 16', 17, 17') and the blast nozzle bars (18, 19) form an inner chamber (24, 25) and an outer chamber (26, 27), and wherein the inner chamber (24, 25) and the outer chamber (26, 27) are in communication with each other through a chamber opening (28, 29).

7. The device according to claim 6, wherein a length of the blast nozzle bars (18, 19) corresponds at least to the strip width and a width of the blast nozzle bars (18, 19) is 10 mm to 500 mm.

8. The device according to claim 7, wherein the width of the blast nozzle bars (18, 19) is 60 mm.

9. The device according to claim 6, wherein, per 1 m of blast nozzle bar length, 250 blast nozzles (23) with a nozzle diameter of 1 mm are arranged in the blast nozzle bars (18, 19).

10. The device according to claim 6, wherein the blast nozzles (23) are arranged in the blast nozzle bars (18, 19) centrally relative to the width of the blast nozzle bars and successively transversely across the entire strip width.

11. The device according to claim 6, wherein a gap (30) between the strip surfaces and the blast nozzle bar surfaces facing the strip has a width of 0.1 to 1.0 mm.

12. The device according to claim 11, wherein the width of the gap is 0.2 mm.

* * * * *